United States Patent [19]

Spielvogel

[11] 4,423,743

[45] Jan. 3, 1984

[54] GRAVITY HELD ASHTRAY APPARATUS

[76] Inventor: Alfonse Spielvogel, 10261 Delano Dr., Cypress, Calif. 90630

[21] Appl. No.: 278,048

[22] Filed: Jun. 29, 1981

[51] Int. Cl.[3] ..... A24F 19/00; A24F 19/10

[52] U.S. Cl. ..... 131/231; 131/240 R; 131/241; 4/301

[58] Field of Search ..... 131/231-242, 131/329; 4/628, 631, 654, 301, 239; D23/68; D6/89; D27/2, 14, 15, 8, 16, 17, 5

[56] References Cited

U.S. PATENT DOCUMENTS

| | | | |
|---|---|---|---|
| D. 185,484 | 6/1959 | Zychick | D6/89 |
| D. 228,842 | 10/1973 | Tegher | D6/89 |
| D. 231,166 | 4/1974 | Tegher | D6/89 |
| D. 252,404 | 7/1979 | Basterfield | D23/68 |
| 2,232,031 | 2/1941 | Kavanagh | 131/238 |
| 2,282,422 | 5/1942 | Gallagher | 131/235 |
| 2,730,106 | 1/1956 | York | 131/235 |
| 3,387,614 | 6/1968 | Beuscher | 131/232 |
| 3,620,225 | 11/1971 | Balley | 131/235 |

*Primary Examiner*—V. Millin

*Attorney, Agent, or Firm*—Fulwider, Patton, Rieber, Lee & Utecht

[57] ABSTRACT

A gravity held ashtray formed with an upwardly opening cup shaped tray and a downwardly projecting stem formed with a downwardly opening hexagonal socket for close fitting over the hex head included in the plumbing fixture leading to a stand-up urinal.

3 Claims, 4 Drawing Figures

FIG. 1
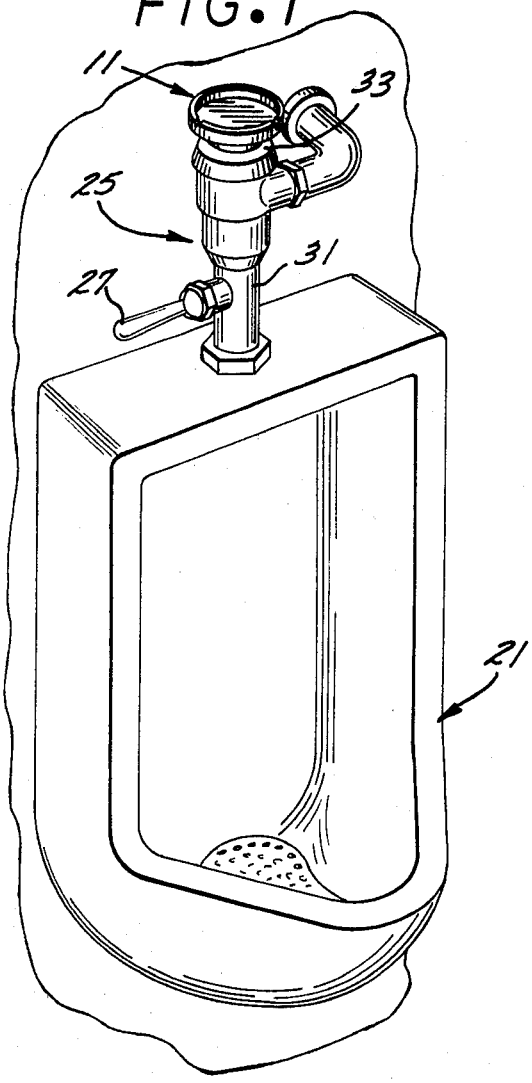
FIG. 2
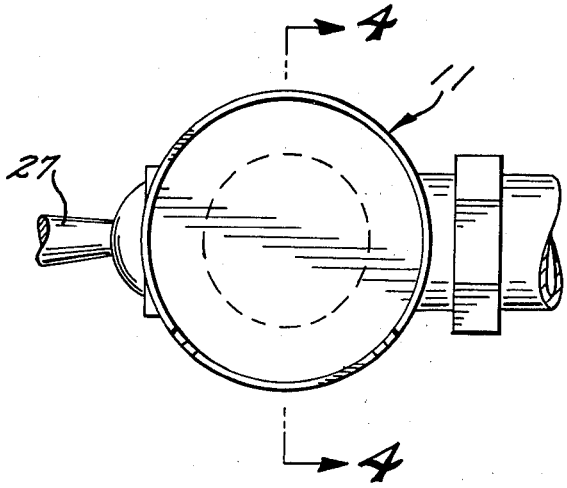
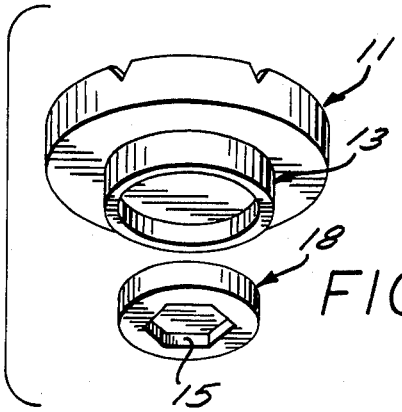
FIG. 3
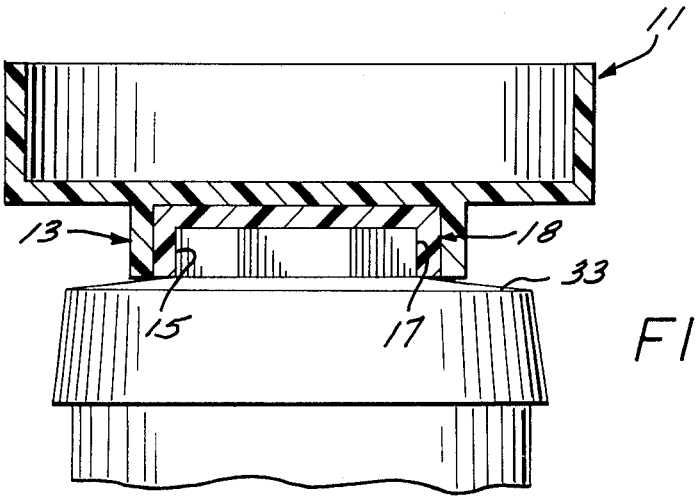
FIG. 4

GRAVITY HELD ASHTRAY APPARATUS

BACKGROUND OF THE INVENTION

1. Field of the Invention

The present invention relates to an ashtray which may be conveniently mounted on the plumbing leading to a stand-up urinal.

2. Description of the Prior Art

Numerous different ashtrays have been proposed, the most typical being in the form of an upwardly opening cup shaped tray formed on its underside with a flat surface for resting on the top side of a horizontal support structure. Such ashtrays, while serving the general purpose well, suffer the shortcoming that they are not conveniently held in a desired position on a support structure to discourage movement thereof about, thus assuring ready availability when use thereof is desired. Other styles of ashtrays include upwardly opening cup shaped trays setting on flexible bags filled with weighted grannular material which conforms in contour to that of an underlying support structure such as the dashboard of an automobile or armrest thereof.

Other ashtrays have been proposed which are formed in their bottom walls with apertures for receiving mounting studs or bolts such that the ashtrays themselves can be mounted from a support structure. However, such ashtrays suffer the inconvenience that the mounting bolts or studs must be removed each time the ashtray is removed from the support structure for dumping the ash therefrom.

SUMMARY OF THE INVENTION

The gravity held ashtray of the present invention is characterized by an upwardly opening top shaped tray formed on its underside with a boss defining a downwardly opening socket for close fit over a hexagonal head formed in the plumbing fixture leading to a stand-up urnial.

These and other features of the invention will become apparent from a consideration of the following description of the drawings.

BRIEF DESCRIPTION OF THE DRAWINGS

FIG. 1 is a perspective view of a stand-up urinal having a gravity held ashtray of the present invention mounted thereon;

FIG. 2 is a top plan view, in enlarged scale, of the gravity held ashtray shown in FIG. 1;

FIG. 3 is a perspective exploded view, in enlarged scale, of the gravity held ashtray shown in FIG. 2; and, FIG. 4 is a transverse sectional view, in enlarged scale, taken along the line 4—4 of FIG. 2.

DESCRIPTION OF THE PREFERRED EMBODIMENT

Referring to FIGS. 3 and 4, the gravity held ashtray of the present invention includes, generally, an upwardly opening cup forming an open top tray 11 and including on the bottom side thereof, a boss assembly defining a stem 13 formed with a downwardly opening socket 15. The socket 15 is formed to be close fit over a hexagonal nut 17 formed in the plumbing fixture on top of a stand-up urinal, generally designated 21 (FIG. 1).

With continued reference to FIGS. 1, 3 and 4, the gravity held ashtray apparatus of the present invention may be constructed of any desired material, such as hard plastic and may be formed with a tray 11 of any desired shape but is shown in the preferred embodiment with a generally cylindrically shaped tray.

In the preferred embodiment, the boss assembly 13 is formed with a downwardly opening tube 16 integral with the tray 11. Press fit into the tube 16 is an insert 18 formed with the hexagonal socket 15 for close complimentary fitting over the particular hexagonal nut 17 included in the plumbing fixture 25. The socket 15 is formed with a top wall defining a flat downwardly facing bearing surface which sets directly on the upwardly facing surface defined by the top side of the nut 17. While the socket 15 could be formed by the interior of the tube 13, it is preferrable that varous inserts 18 incorporating sockets 15 of different size, be provided for interchangeable replacement in the tube 13 so the insert having the socket fitting the particular hex nut 17 may be selected.

Referring to FIG. 1, conventional stand-up urinals 21 frequently have connected to the top wall thereof, a flush mechanism, generally designated 25, which include a valve handle 27 mounted on an upstanding stem 31 which is capped on its top end by a cap 33 having a hex nut 17 formed integral therewith. The hex nuts 17 may be of any one of a number of different standard dimensions, such as one inch across the facets thereof. For the particular configuration depicted, the socket 15 is formed with a hexagonal shape to be slip fit on the hex nut 17 so that the ash tray 11 will be held firmly in position once placed on such hex nut.

In operation, an individual ash tray 11 will be mounted on each of the hex nuts 17 of the various urinals 21 of a public bathroom such that the tray itself will be disposed in plain sight and arranged for convenient use by a user of the urinal 21. Thus, the user will be encouraged to use the ash tray 11 for disposal of ashes, cigarette butts, cigar butts and the like.

During the daily cleaning of the restroom, the ash trays 11 may be conveniently grasped and lifted off the respective hex nuts 17 and the ashes and butts dumped from the ash tray 11. The ash trays 11 may then be conveniently slipped back onto the hex nut 17 where they will be held firmly in position by the interior top wall of the socket 15 resting on top of the hex nut 17 and the bottom extremities of the side walls thereof abutting the top surface of the cap 33. Consequently, the ash trays 11 will be held securely in position and repositioning thereof to various locations thereof throughout the facility will be discouraged, thus maintaining such ash trays in position for convenient use by urinal users.

In the event the restroom incorporates plumbing fixtures 25 having various size hex nuts 17, inserts 18 having sockets 15 of the particular size to accommodate the various nuts may be installed in the tubes 13 of certain ones of the ashtrays 11 for mounting on such various size hex nuts.

It will be appreciated that with the gravity held ashtray apparatus of the present invention, the ashtrays will be conveniently mounted on top of urinals and will be held firmly in position by gravity pull thereon and can also be conveniently renewed for dumping of ashes from the ashtray.

I claim:

1. A gravity held ashtray apparatus for mounting on an upstanding hex nut assembly included in the plumbing leading to a urinal and formed with an upwardly facing surface, said apparatus including:

an upwardly opening cup-shaped ashtray for receiving ashes; and a boss assembly formed on the bottom of said ashtray and including a downwardly opening hexagonal shaped socket for closely and removably fitting over said hex nut and including a substantially flat downwardly facing bearing surface for setting on said upwardly facing surface of said hex nut assembly, said boss assembly further including a peripheral wall surrounding said bearing surface to define the hexagonal shape of said socket to complementally fit over the facets of said hex nut to support said ashtray from shifting and tipping relative to said hex nut assembly whereby said socket may be removably inserted on said hex nut assembly to be supported thereon by said bearing surface, said boss assembly including a downwardly opening tube and an insert removably received in said tube and formed with said hexagonal shaped socket.

2. An ashtray apparatus as set forth in claim 1 wherein said insert is formed to be press fit into said tube.

3. An ashtray apparatus as set forth in claim 1 wherein said upwardly opening cup-shaped ashtray includes a side wall having a notch for holding a cigarette.

* * * * *